United States Patent [19]

Bashir

[11] Patent Number: 4,998,839

[45] Date of Patent: Mar. 12, 1991

[54] APPLICATOR FOR NAIL POLISH REMOVER

[76] Inventor: Irfan Bashir, 23-74 29th St. - Apt. 15, Astoria, N.Y. 11105

[21] Appl. No.: 494,503

[22] Filed: Mar. 16, 1990

[51] Int. Cl.[5] ..... A45D 34/00; A45D 34/04; B05C 17/02

[52] U.S. Cl. ..... 401/208; 401/213; 132/74.5

[58] Field of Search ..... 401/208; 118/257, 260; 15/231, 109.94, 230; 132/74.5

[56] References Cited

U.S. PATENT DOCUMENTS

| | | | |
|---|---|---|---|
| 154,195 | 8/1874 | Smith | 401/208 |
| 1,705,450 | 3/1929 | Mullen | 118/257 |
| 2,057,085 | 10/1936 | Danco | 401/208 |
| 4,112,536 | 9/1978 | Carson | 401/208 |
| 4,152,803 | 5/1979 | Gersin | 15/231 |
| 4,627,758 | 12/1986 | Winthrop | 401/208 |

FOREIGN PATENT DOCUMENTS

| | | | |
|---|---|---|---|
| 63187 | 9/1913 | Fed. Rep. of Germany | 401/208 |

*Primary Examiner*—Richard J. Johnson
*Attorney, Agent, or Firm*—Iman Abdallah

[57] ABSTRACT

A liquid nail polish remover applicator that permits disposal of soiled absorbent material within the applicator. The applicator is formed as a hollow housing member having a first chamber which houses a wetted coiled strip of absorbent material and a second chamber which receives soiled absorbent material, the first and second chambers being separated by a flexible membrane which permits enlargement of the space within the second chamber by displacement of the space within the first chamber. The absorbent material is fed through said housing member by a manually operated gear mechanism. An opening is formed within the housing member between said first chamber and said second chamber to selectively expose axial portions of the absorbent matrial.

6 Claims, 2 Drawing Sheets

APPLICATOR FOR NAIL POLISH REMOVER

BACKGROUND OF THE INVENTION

The present invention generally relates to nail care products. More particularly, this invention relates to improved means for removing nail polish from the fingers and toes.

In U.S. Pat. No. 4,627,758 to Winthrop a nail polish removing apparatus is disclosed wherein a hollow housing includes a reservoir for nail polish removing liquid which communicates with a continuous belt of absorbent material. Axial portions of said absorbent material can be rotated to an opening formed in said housing for selective dispensation of the nail polish removing liquid to a fingernail or toenail of the user. The Winthrop apparatus requires that soiled absorbent material be repeatedly utilized for application of the liquid to a nail. Nail polish residue is suspended in the removing liquid when axial portions of the continuous belt are returned to the liquid reservoir, however, utilizing the Winthrop invention a portion of the removed nail polish remains embedded in the absorbent material and the suspended residue may re-absorb in the continuous belt. Furthermore, the Winthrop apparatus does not provide support cushioning means for the axial portions of the continuous belt that permit forceful pressing of the exposed portions of absorbent material against the user's nails.

SUMMARY OF THE INVENTION

The present invention discloses an applicator for liquid nail polish remover comprising a hollow housing member having a first chamber which houses a wetted coiled strip of absorbent material and a second chamber which receives soiled absorbent material providing means for internal disposal of soiled absorbent material. The coiled strip of absorbent material is fed from the first chamber to the second chamber by a manually operated gear mechanism fixedly attached to the housing member. Axial portions of said absorbent material are selectively exposed in cushioned support at an opening formed in the housing member. The first chamber and the second chamber are separated by a flexible membrane that permits the soiled absorbent material disposed within the second chamber to displace the volume of the first chamber as the absorbent material is fed therefrom.

An object of the present invention is to provide a nail polish remover applicator that permits continuous exposure of clean wetted axial portions of absorbent material.

Another object of the present invention is to provide a nail polish remover applicator that permits internal disposal of soiled absorbent material.

It is also an object of this invention to provide an applicator for nail polish remover that includes cushioned support for the exposed axial portions of the absorbent material.

These and other objects and advantages of the present invention will be apparent to those skilled in the art from the following description of a preferred embodiment, claims and accompanying drawings.

DESCRIPTION OF THE PREFERRED EMBODIMENT

Figure 1:
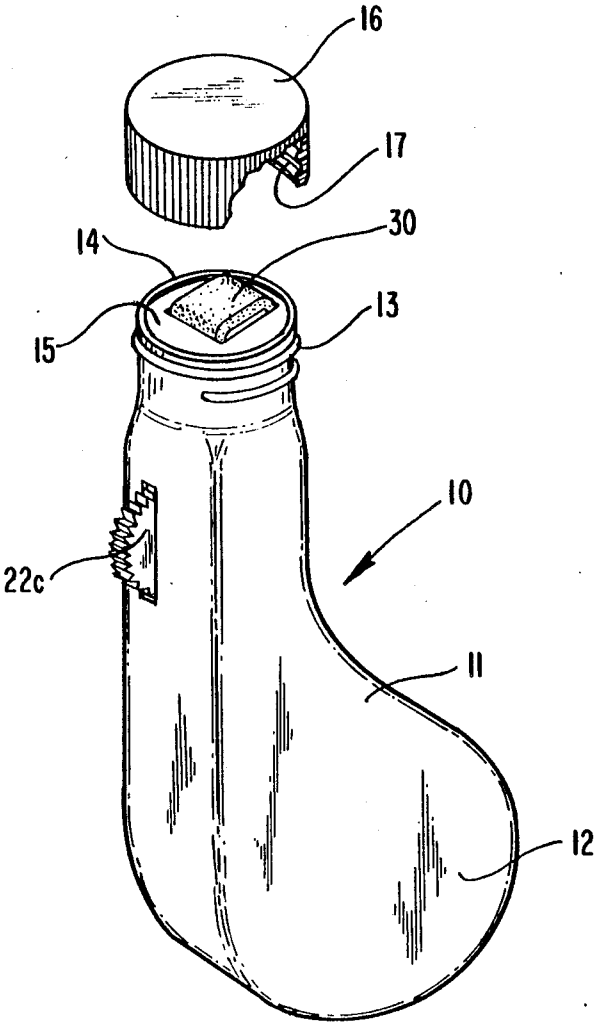
FIG. 1 is a perspective view of the nail polish remover applicator of the present invention.

FIG. 1 illustrates in a perspective view the nail polish remover applicator 10 of the present invention. Applicator 10 includes a hollow elongated housing member 11 having a wide bottom portion 12 and threaded narrow top portion 13. An opening 14 is formed in the top wall 15 of the housing member 11 which permits exposure of an axial portion of absorbent material 30. A screw cap 16 having threads 17 formed on its inner wall which complement the threads formed on the narrow top portion 13 of said housing member 11 is provided as a cover for the exposed absorbent material 30 and means for closing the housing member 11.

Figure 2:
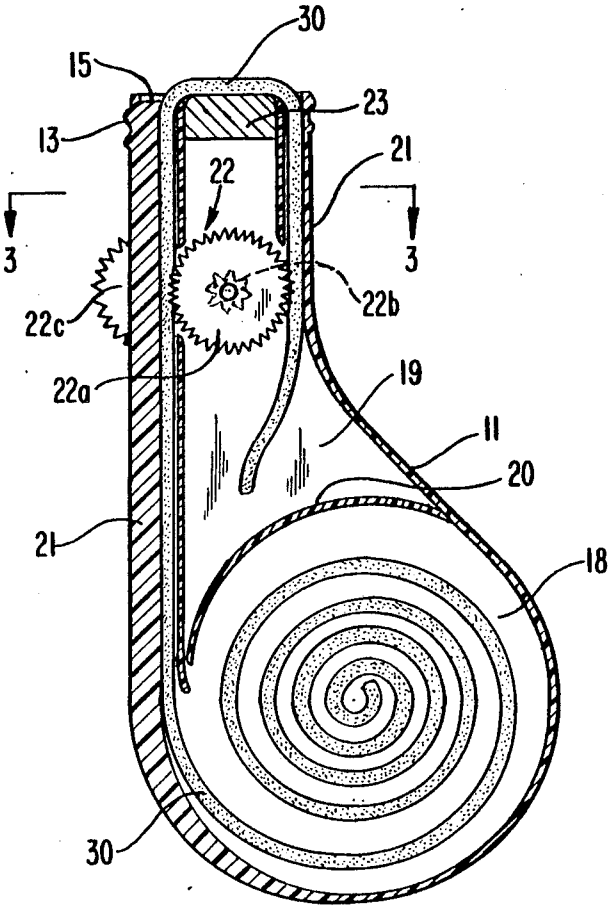
FIG. 2 is a side plan cross-sectional view of the applicator.

Referring now to FIG. 2 the applicator 10 can be seen to include a first chamber 18 disposed at the bottom portion of the housing member 11 which houses a wetted coil of absorbent material 30 and a second chamber 19 disposed adjacent to said first chamber 18 provided to receive soiled absorbent material 30. Said first chamber 18 and said second chamber 19 are separated by a flexible membrane 20 which is cantilevered from a side wall of said housing member 11. The applicator 10 further includes a channel 21 formed in said housing member 11 which communicates with said first chamber 18 and said second chamber 19 and extends past the opening 14 formed in the top wall 15 of said housing member 11. The absorbent material 30 is fed through said channel 21 by manual operation of a gear mechanism 22 as hereinafter described in greater detail. In the preferred embodiment the flexible membrane 20 is formed from a pervious material having a mesh that will retain residue of nail polish within said second chamber 19 and permit the liquid nail polish remover to drain back into said first chamber 18. Thereby the coiled strip of absorbent material 30 can be continually wetted as the applicator 10 is used which has the effect of extending the life of the applicator 10. Applicator 10 also includes a nail cushion 23 formed from resilient material fixedly attached within said housing member 11 at the narrow top portion 13 of said housing member 11. Said cushion 23 is disposed to the opposite side of the axial portion of absorbent material 30 from said opening 14.

Figure 4:
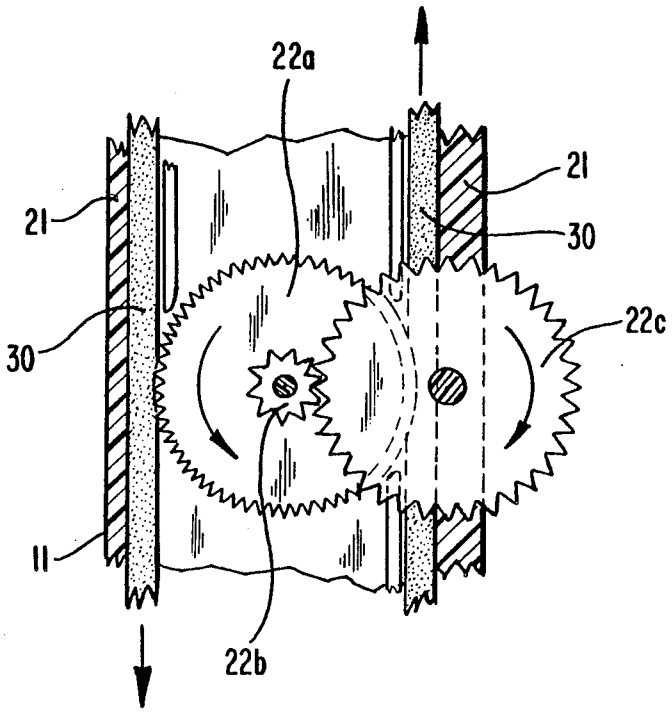
FIG. 4 is a side plan view taken along line B—B of FIG. 3.
Figure 3:
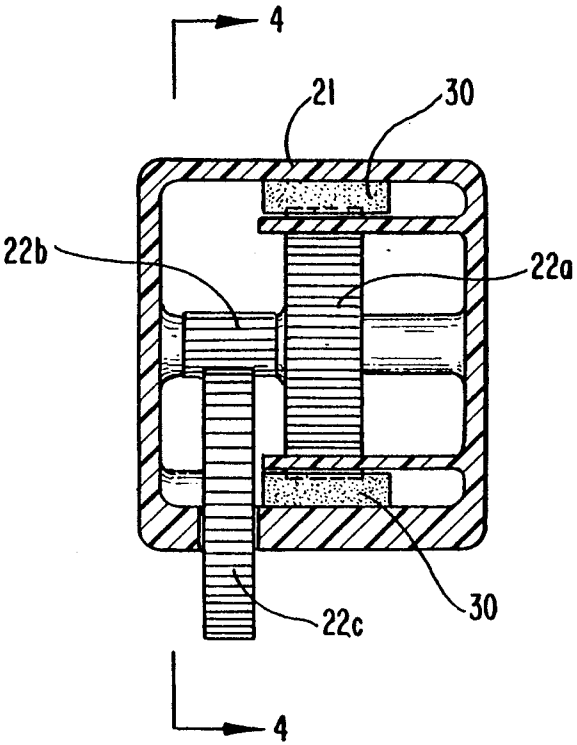
FIG. 3 is a top plan view taken along line A—A of FIG. 2.

As can be seen in FIGS. 3 and 4 the gear mechanism 22 comprises a material grasping gear wheel **22*a*, a turning gear wheel 22*b* and an operating gear wheel 22*c*. The material grasping gear wheel 22*a* and turning gear wheel 22*b* are fixedly attached in coaxial alignment and rotatably attached to the inside walls of said housing member 11. A plurality of peripheral serrations are formed on said material grasping gear wheel 22*a* and said turning gear wheel 22*b* includes a plurality of gear teeth formed on its periphery. Operating gear wheel 22*c* is disposed in parallel alignment with said turning gear wheel 22*b*, said operating gear wheel 22*c* having peripheral teeth which engage the teeth of said turning gear wheel 22*b*. The operating gear wheel 22*c* extends beyond the body of said housing member 11 to permit manual rotation of said operating wheel 22*c* by the thumb or finger of the user. The serrations of said material grasping gear wheel 22*a* engage the absorbent material 30 at portions of the absorbent material 30 both rearward and forward of said opening 14 and by operation of the gear mechanism 22 the absorbent material 30 is moved through channel 21 of said housing member 11. By rotation of the operating gear wheel 22*c* the turning gear wheel 22*b* is caused to rotate in the opposite direction and thereby rotate the material grasping gear wheel 22*a* and move the absorbent material 30 through the channel 21. Thus by rotation of the operating wheel 22*c* the absorbent material 30 i selectively moved through the channel 21 of said housing member 11 to expose clean axial portions of the absorbent material 30 at the opening 14. As the absorbent material 30 is moved through the channel 21 it is deposited within said second chamber 19**.

Therefore, in view of the foregoing I claim:

1. A portable applicator for liquid nail polish remover comprising a hollow elongated housing member having a first chamber formed at the bottom end of said housing member, a second chamber formed adjacent to said first chamber, an opening formed at the top end of said housing member, and a channel which communicates with said first chamber and said second chamber via the opening formed at the top of said housing member, said first chamber and said second chamber being separated by a flexible membrane that is attached at one point to a side wall of said housing member;

a coiled strip of wetted absorbent material disposed within said first chamber having axial portions thereof feedable through said channel to said second chamber;

means for manually feeding axial portions of said strip of absorbent material past said opening into said second chamber; and a cap for the top end of said housing member.

2. A portable applicator for liquid nail polish remover as described in claim 1 wherein said flexible membrane is formed from a material having a mesh that is pervious to the liquid nail polish remover and retains nail polish residue within said second chamber.

3. A portable applicator for liquid nail polish remover as described in claim 1 wherein said feeding means comprises a rotatable gear assembly fixedly attached to said housing member, said gear assembly having a material grasping gear wheel formed with peripheral serrations which engage said strip of absorbent material, a turning gear wheel having gear teeth and being fixedly attached to said material grasping gear wheel in axial alignment, and an operating gear wheel which extends beyond the outside wall of said housing member, said operating gear wheel being formed with gear teeth which engage the gear teeth of said turning gear wheel in turning engagement.

4. A portable applicator for liquid nail polish remover comprising a hollow elongated housing member having a first chamber formed at the bottom end of said housing member, a second chamber formed adjacent to said first chamber, an opening formed at the top end of said housing member, and a channel which communicates with said first chamber and said second chamber via the opening formed at the top of said housing member, said first chamber and said second chamber being separated by a flexible membrane that is cantilevered to a side wall of said housing member, said flexible membrane being formed of material having a mesh that is pervious to the liquid nail polish remover and retains nail polish residue within said second chamber.

a coiled strip of absorbent material disposed within said first chamber having axial portions thereof feedable through said channel to said second chamber;

means for manually feeding axial portions of said strip of absorbent material past said opening into said second chamber, said feeding means comprising a rotatable gear assembly fixedly attached to said housing member, said gear assembly having a material grasping gear wheel formed with peripheral serrations which engage said strip of absorbent material, a turning gear wheel having gear teeth and being fixedly attached to said material grasping gear wheel in axial alignment, and an operating gear wheel which extends beyond the outside wall of said housing member, said operating gear wheel being formed with gear teeth which engage the gear teeth of said turning gear wheel in turning engagement; and a cushion disposed to the opposite side of said absorbent material from said opening adjacent to the axial portions of the absorbent material exposed at the opening of said housing member, said cushion being formed from resilient material.

5. A portable applicator for liquid nail polish remover comprising a hollow elongated housing member having a first chamber formed at a bottom end of said housing member, a second chamber formed adjacent to said first chamber, an opening formed at the top end of said housing member, and a channel which communicates with said first chamber and said second chamber via said opening, said first chamber and said second chamber being separated by a membrane attached to a side wall of said housing member;

a coiled strip of absorbent material wetted with nail polish removed and disposed within said first chamber, said strip of absorbent material having axial portions thereof feedable through said channel to said second chamber;

means to feed axial portions of said strip of absorbent material from said first chamber to said second chamber comprising a rotatable gear assembly fixedly attached to said housing member, said gear assembly having a material grasping gear wheel formed with peripheral serrations which engage said strip of absorbent material, a turning gear wheel having gear teeth and being fixedly attached to said material grasping gear wheel in axial alignment, and an operating gear wheel which extends beyond the outside wall of said housing member, said operating gear wheel being formed with gear teeth which engage the gear teeth of said turning gear wheel in turning engagement.

6. A portable applicator for liquid nail polish remover comprising a hollow elongated housing member having a first chamber formed at one end of said housing member, a second chamber formed adjacent to said first chamber, an opening formed at the opposite end of said housing member, and a channel communicating with said first chamber and said second chamber via said opening, said first chamber and said second chamber being separated by a membrane extending from said channel to a side wall of said housing, said membrane being fixedly attached only at said side wall;

a coiled strip of absorbent material wetted with nail polish remover and disposed within said first chamber, said strip of absorbent material having axial portions thereof feedable through said channel to said second chamber; and means to feed said axial portions of said strip of absorbent material from said first chamber past said opening and into said second chamber.

* * * * *